United States Patent [19]

Tanikawa et al.

[11] 4,430,723

[45] Feb. 7, 1984

[54] SEMICONDUCTOR MATRIX OPERATION DEVICE

[76] Inventors: Kunihiro Tanikawa, Akashi; Yuichiro Ito, Kobe; Mitsuo Ishii, Yokohama, all of Japan

[21] Appl. No.: 271,587

[22] Filed: Jun. 8, 1981

Related U.S. Application Data

[63] Continuation of Ser. No. 71,270, Aug. 30, 1979, abandoned, which is a continuation of Ser. No. 879,879, Feb. 2, 1978, abandoned.

[30] Foreign Application Priority Data

Feb. 24, 1977 [JP] Japan ..... 52-20106

[51] Int. Cl.[3] ..... G06G 7/16

[52] U.S. Cl. ..... 364/862; 364/844; 377/63

[58] Field of Search ..... 364/844, 862, 824, 825, 364/841, 724; 307/221; 328/167; 377/57-63; 357/24

[56] References Cited

U.S. PATENT DOCUMENTS

| | | | |
|---|---|---|---|
| 3,500,215 | 3/1970 | Leuthold et al. | 307/221 D X |
| 3,543,009 | 11/1970 | Voelcker, Jr. | 364/724 |
| 3,631,232 | 12/1971 | Perreault et al. | 364/862 X |
| 3,997,973 | 12/1976 | Buss | 364/862 X |
| 4,011,441 | 3/1977 | Michon et al. | 364/862 |
| 4,011,442 | 3/1977 | Engeler | 364/862 |
| 4,045,795 | 8/1977 | Fletcher et al. | 364/862 X |
| 4,071,906 | 1/1978 | Buss | 364/862 X |
| 4,084,256 | 4/1978 | Engeler et al. | 364/862 |
| 4,161,706 | 7/1979 | Dubil et al. | 364/862 X |

OTHER PUBLICATIONS

Mavor-"Signal Processing Applications of Charge-Coupled Devices"-The Radio and Electronic Engineer, vol. 46, No. 819, pp. 412-420, Aug./Sep. 1976.

*Primary Examiner*—Joseph F. Ruggiero

[57] ABSTRACT

A matrix operation device performs matrix multiplication of an input electrical signal by utilizing a plurality of charge-coupled devices having split electrodes. The multiplication is carried out by the split electrodes of the charge-coupled devices. A signal to be transformed is sampled by a delay circuit in the input of the operation device. The sampled signal is supplied to the operation device in the form of a time series or sequence consisting of the sample signals. Each sample is multiplied by a corresponding coefficient. The split electrodes of the charge-coupled devices have weighting coefficients corresponding to coefficients in the matrix. The samples multiplied by the coefficients are added in the output of the operation device and provided as an output signal, corresponding to the development of the matrix multiplication.

5 Claims, 10 Drawing Figures

SEMICONDUCTOR MATRIX OPERATION DEVICE

This is a continuation of application Ser. No. 071,270, filed Aug. 30, 1979 abandoned, which, in turn, is a continuation-in-part of application Ser. No. 879,879, filed Feb. 2, 1978 abandoned.

BACKGROUND OF THE INVENTION

The present invention relates to a semiconductor matrix operation device. More particularly, the invention relates to a semiconductor signal transforming device.

It is known that the nature of an electrical signal may be determined by the process of orthogonal transformation applied to such signal. Furthermore, it becomes unnecessary to inevitably widen the occupied frequency bandwidth at the time of transmitting the signal. It is, of course, possible to perform such transformation in a computer, by using proper algorithms. In general, however, if an available device is prepared only for a certain kind of orthogonal transformation such as, for example, a Fourier transformation, more particularly for providing the result of transformation as an output when a signal to be transformed is applied as an input, such device will contribute greatly to operation.

A recently developed algorithm is known as a fast Fourier transformation. In such algorithm, the Fourier transformation is performed in the form of a sampling. Operation in accordance with this method is very simplified, so that a large scale integrated circuit is still required, although an integrated circuit only for fast Fourier transformation has been developed recently.

On the other hand, as is well known, a transversal filter utilizing a charge-coupled device, or CCD, provides the same filtering effect as an electrical filter consisting of the combination of an ordinary resistor, capacitor and inductor, by utilizing the characteristic of the CCD as an analog delay line.

The transversal filter, however, only eliminates or reduces the specified frequency component of an input signal. This, in itself, is different from an orthogonal transformation.

The principal object of the invention is to provide a semiconductor matrix operation device utilizing a CCD.

An object of the invention is to provide a semiconductor matrix operation device of simple structure utilizing a CCD having split electrodes.

Another object of the invention is to provide a semiconductor matrix operation device of simple structure utilizing a CCD having split electrodes as the operation unit.

Still another object of the invention is to provide a signal transformation device utilizing a CCD having split electrodes as the operation unit.

Yet another object of the invention is to provide a semiconductor signal transformation device having a delay circuit in the input of the operation unit.

Another object of the invention is to provide a matrix operation device having an operation unit and input circuits integrated on a sheet of semiconductor substrate.

BRIEF SUMMARY OF THE INVENTION

In accordance with the invention, a semiconductor signal transforming device comprises an operation device having a plurality of units including charge transfer devices each having split electrodes for a plurality of systems. The operation device has an input and an output. An input circuit is connected to the input of the operation device. The input circuit includes a plurality of analog delay circuits each having a final stage, a delay time and a transfer direction which is the same as that of each unit of the operation device. The delay times of the delay circuits form an arithmetic series. The input circuit provides sampled data of an input signal to be transformed as a simultaneous input to all the delay circuits. The final stage of each of the delay circuits has a charge which is the sampled data of the input signal at respectively different instants. An adder circuit is connected to the output of the operation device.

Each of the analog delay circuits comprises a plurality of charge transfer devices. Each of the charge transfer devices has a plurality of transfer stages forming an arithmetic series.

A signal to be transformed is non-delayed, and the signal is supplied only to one charge transfer device of the operation device.

The delay circuits have different delay times. A signal to be transformed is supplied to the delay circuits and is supplied to the charge transfer devices of the operation device after it passes through the delay circuits.

Each of the delay circuits comprises a charge transfer device having a transfer electrode. The length of the transfer electrode of each of the charge transfer devices increases, the closer the charge transfer device is to the operation device.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The operation of the semiconductor matrix operation device of the invention is generally expressed by the following equation.

$$\begin{pmatrix} F_0 \\ F_1 \\ F_2 \\ \vdots \\ F_{N-1} \end{pmatrix} = \begin{pmatrix} C_{0,0} & C_{1,0} & \cdots & C_{N-1,0} \\ C_{0,1} & C_{1,1} & \cdots & C_{N-1,1} \\ C_{0,2} & C_{1,2} & \cdots & C_{N-1,2} \\ \vdots & \vdots & & \vdots \\ C_{0,N-1} & C_{1,N-1} & & C_{N-1,N-1} \end{pmatrix} \begin{pmatrix} g_0 \\ g_1 \\ g_2 \\ \vdots \\ g_{N-1} \end{pmatrix} \quad (1)$$

In a signal transformation device related to the invention, each element $g_0$ to $g_{N-1}$ of the column vector on the right side of the equal sign is applied as the input sequence and each element $F_0$ to $F_{N-1}$ of the column vector on the left side of the equal sign is obtained as an output. The operation of multiplying matrix to the column vector on the right side is performed in the operation device. This operation is carried out by injecting a charge proportional to $g_0$ to $g_{N-1}$ to each CCD, charge-coupled device, or in the operation device. The operation is also carried out by permitting each CCD to execute a specified transfer operation.

In addition, it is necessary to arrange the timing of the aforedescribed charge injection so that the desired output can be obtained in order to make the operation device perform the aforementioned operations. The input circuit performs these operations.

Figure 1:
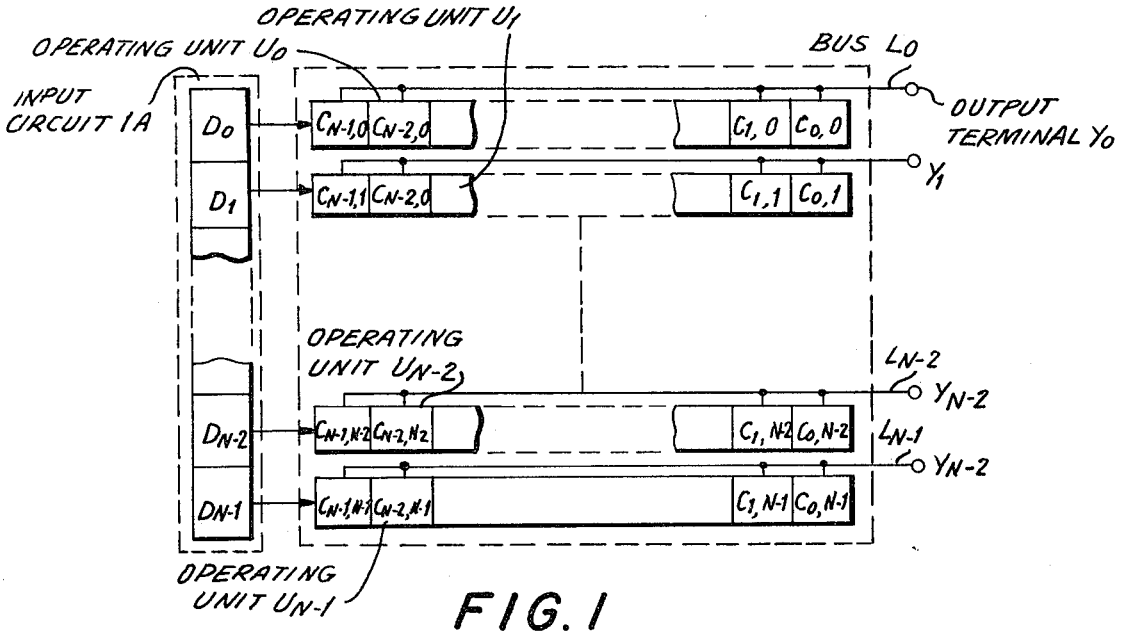
FIG. 1 is a block diagram of a basic embodiment of the semiconductor matrix operation device of the invention.

The operation process is explained as follows. The configuration of an operation device in a signal transformation device related to the invention is roughly classified into two different types. FIG. 1 is a block diagram of a configuration of the first type. In FIG. 1, an input circuit 1A is connected to an operation circuit 18. The elongated rectangular boxes $U_0$, $U_1$, . . . $U_{N-2}$, $U_{N-1}$, respectively, enclosed by thick lines in the operation circuit 1D, are CCDs. Each of the CCDs is for a single channel and has a split electrode. The rectangular boxes within the CCDs, separated by thin vertical lines within the CCDs, are transfer stages. Each transfer stage has an indication therein of the weighting coefficient given to a signal charge by means of the split electrode.

Each CCD, $U_0$, $U_1$, $U_2$, . . . $U_{N-1}$ is hereinafter called an operating unit. In FIG. 1, each weighting coefficient indicated in the operating unit $U_0$ respectively corresponds to the coefficient of each unit in the uppermost row of the matrix of Equation (1), but the right to left sequence is reversed. The fact that each transfer stage is electrically connected to a single bus $L_0$ means that a voltage is added at each stage, and the output of addition is extracted from an output terminal $Y_0$.

If it is assumed that a charge $Q_0$ proportional to the element $g_0$ in the column vector at the right side of Equation (1) is input to the operating unit $U_0$, and transfer is performed to the right, an output voltage proportional to the result of multiplying the coefficient $C_{0,0}$, $C_{1,0}$, $C_{2,0}$ . . . to $g_0$ may be obtained from each column of the operating unit $U_1$. Thus, by sequentially inputting the charges $Q_1$, $Q_2$, $Q_3$, . . . , proportional to the elements $g_1$, $g_2$, $g_3$, . . . , respectively, following the charge $Q_0$ in every transfer period, a voltage $V_0$, appearing at the output terminal $Y_0$ may be expressed by the following equation when said charge $Q_0$ reaches the final stage of the operating unit $U_0$.

$$V_0 = K(C_{0,0}g_0 + C_{1,0}g_1 + C_{2,0}g_2 + \ldots + C_{N-1,0}g_{N-1}) \quad (2)$$

wherein K is a proportional constant.

When comparing Equation (2) with Equation (1), the following relation may be understood immediately.

$$V_0 = KF_0 \quad (3)$$

The operating units $U_1$, . . . , $U_{N-1}$, shown in FIG. 1, have the same configuration and the only difference between them is the weighting coefficient. Therefore, a comparison between the matrix of Equation (1) and each weighting coefficient of FIG. 1 apparently proves that the following equation may be adopted to each unit by generalizing Equation (3).

$$V_i = KF_i \quad (4)$$

wherein $V_i$ is an output voltage appearing at the output terminal $Y_i$, and i is an integer freely selected within the range of 0 to N-1.

The aforementioned result makes it obvious that an output of each operating unit shown in FIG. 1 is proportional to $F_i$. Therefore, the device shown in FIG. 1 is capable of executing the operation expressed by Equation (1). However, when an input is applied simultaneously to all operating units, processing becomes troublesome, since an output also appears simultaneously at every output terminal $Y_0$, $Y_1$, . . . , $Y_{N-1}$. Thus, in the device of the invention, input timing of the signal charge is adjusted at the input circuit 1A before the signal charge enters the operating circuit 1B, so that the signal charge enters the operating device 1B at the desired timing.

Figure 1A:
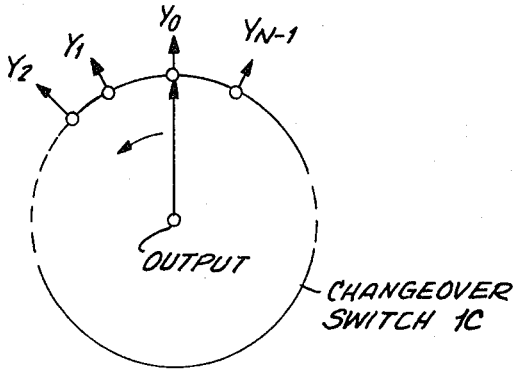
FIG. 1A is a schematic diagram of an embodiment of a changeover switch of the device of FIG. 1.

As an example, in FIG. 1, the signal charge is input by delaying every sequence by one transfer period for each unit. Delay lines $D_0$, $D_1$, . . . , $D_{N-1}$ in the input circuit 1A are delay lines resulting in the delay times of 0, $\tau$, $2\tau$, $3\tau$, . . . (N-1)$\tau$. Generally, the signal charge enters the operating unit $U_{i+1}$ at a delay time of $\tau$ following the operating unit $U_1$. $\tau$ is a transfer period. Thereby, an output signal proportional to $F_0$, $F_1$, $F_2$, . . . , $F_{N-1}$ respectively, appears at the output terminals $Y_0$, $Y_1$, $Y_2$, . . . , $Y_{N-1}$, respectively, sequentially in every other period of $\tau$. The aforementioned output may be readily obtained via a changeover switch 1C (FIG. 1A).

The principle of the semiconductor matrix operation device of the invention has been hereinbefore described. The following explanation is for an example of a device utilizing a CCD as the operating device. Prior to such explanation, however, the principle of multiplication utilizing a CCD having a split electrode is explained.

Figure 2:
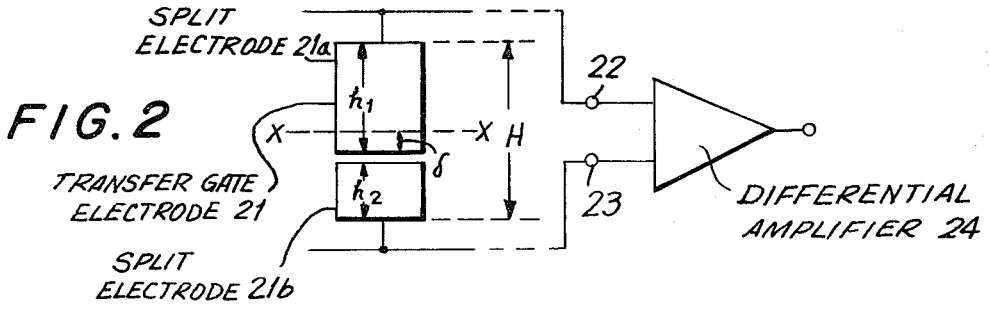
FIG. 2 is a schematic circuit diagram explaining the relation between the split electrode and weight coefficient.

In FIG. 2, a transfer gate or split electrode 21 of a CCD has a rectangular shape and is divided into two electrode portions 21*a* and 21*b* by a dividing line parallel to the short sides. The two portions 21*a* and 21*b* are connected to two input terminals 22 and 23, respectively, of a differential amplifier 24.

When a specified charge Q is supplied to the split electrode 21, a voltage difference appearing at the electrode portions 21*a* and 21*b*, respectively, is proportional to the charge Q and the area of each split electrode. Since the width of both electrode portions or split electrodes is equal, the area is proportional to the length of the vertical sides $h_1$ and $h_2$ of the split electrodes 21*a* and 21*b*, respectively. Thus, the following relation may be obtained when an output appearing at the differential amplifier 24, due to the injection of a charge Q, is considered as e.

$$e=k(h_1-h_2)Q \quad (5)$$

wherein k is a proportional constant.

In FIG. 2, the length of the longer side of the electrode 21 before it is split is considered to be H, a line X-X connects the centers of the two longer sides, and the distance between the split line and the center line X-X is considered to be $\delta$. Since $h_1=H/2+\delta$ and $h_2=H/2-\delta$, Equation (5) may be transferred as $$e=2.k\delta.Q \quad (6)$$

Equation (6) shows that the output voltage of the differential amplifier 24 is proportional to the product of Q and $\delta$. More particularly, it may be said that the electrode 21, shown in FIG. 2, has the function of operation where the coefficient determined by the position of the split, does not depend on the charge Q or the desired input charge Q. The fact that the operation of multiplying a specified coefficient to a signal charge may be performed by a split electrode is well known as a principle of the transversal filter itself. However, in the semiconductor matrix operation device of the invention, correspondence between each split electrode and each element in the matrix is established by using several CCDs having split electrodes, and a signal is added after multiplication. A signal corresponding to the column vector on the right side of Equation (1) is thereby converted to a signal corresponding to each element of the column vector on the left side of the equation.

Figure 3:
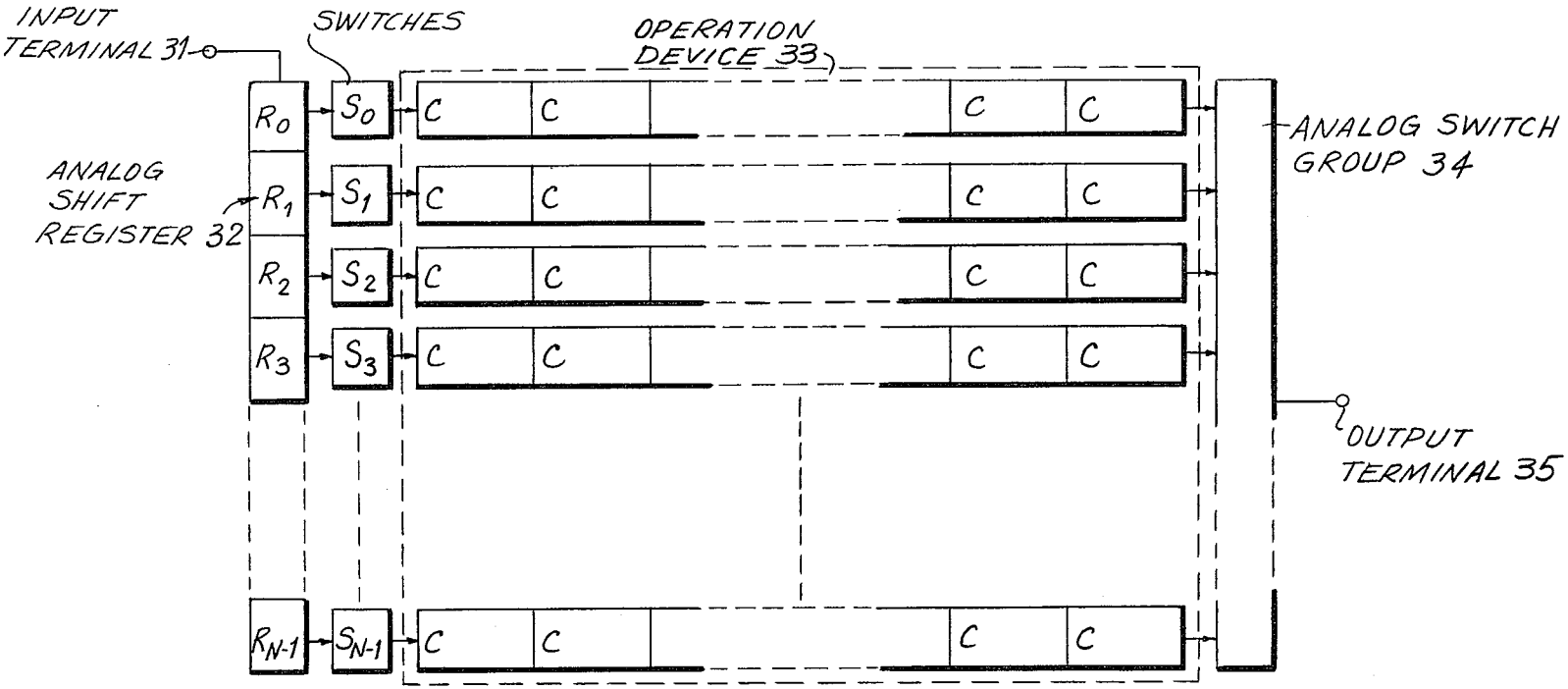
FIG. 3 is a block diagram of a second embodiment of the semiconductor matrix operation device of the invention.

FIG. 3 is a block diagram of an example of a signal transforming system utilizing an analog shift register as the input circuit. In FIG. 3, a signal to be transformed is applied to an input terminal 31. An analog shift register 32, connected to the input terminal 31, has a plurality of stages $R_0, R_1, R_2, \ldots, R_{N-1}$. A plurality of switches $S_0, S_1, S_2, \ldots, S_{N-1}$ are connected to the stages $R_0, R_1, \ldots, R_{N-1}$, respectively, of the shift register 32. The switches $S_0, S_1, \ldots, S_{N-1}$ are set to OFF, except when the desired signal is permitted to pass. An operation device 33 is connected to the switches $S_0, S_1, \ldots, S_{N-1}$ and primarily comprises CCDs of split electrode type.

The coefficients of FIG. 3 are the same as those of FIG. 1. An output is derived from an output terminal 35 via an analog switch group 34. The analog switch group 34 functions to sequentially take out the output signal of each operating unit in the operation device 33 from the upper unit and to separate a unit other than the unit which provides an output signal at the output terminal.

In an embodiment of FIG. 3, the charge transfer direction of the analog shift register 32 in the input circuit crosses the charge transfer direction of each CCD of the operation device 33 almost orthogonally. It is therefore difficult to design the shift register of the input circuit, especially when it is necessary to match the value of the coefficient determined by the split of the electrode with a specified value with great accuracy in the operation device. Therefore, another embodiment, shown in FIG. 4, permits the input circuit to be designed with facility.

Figure 4:
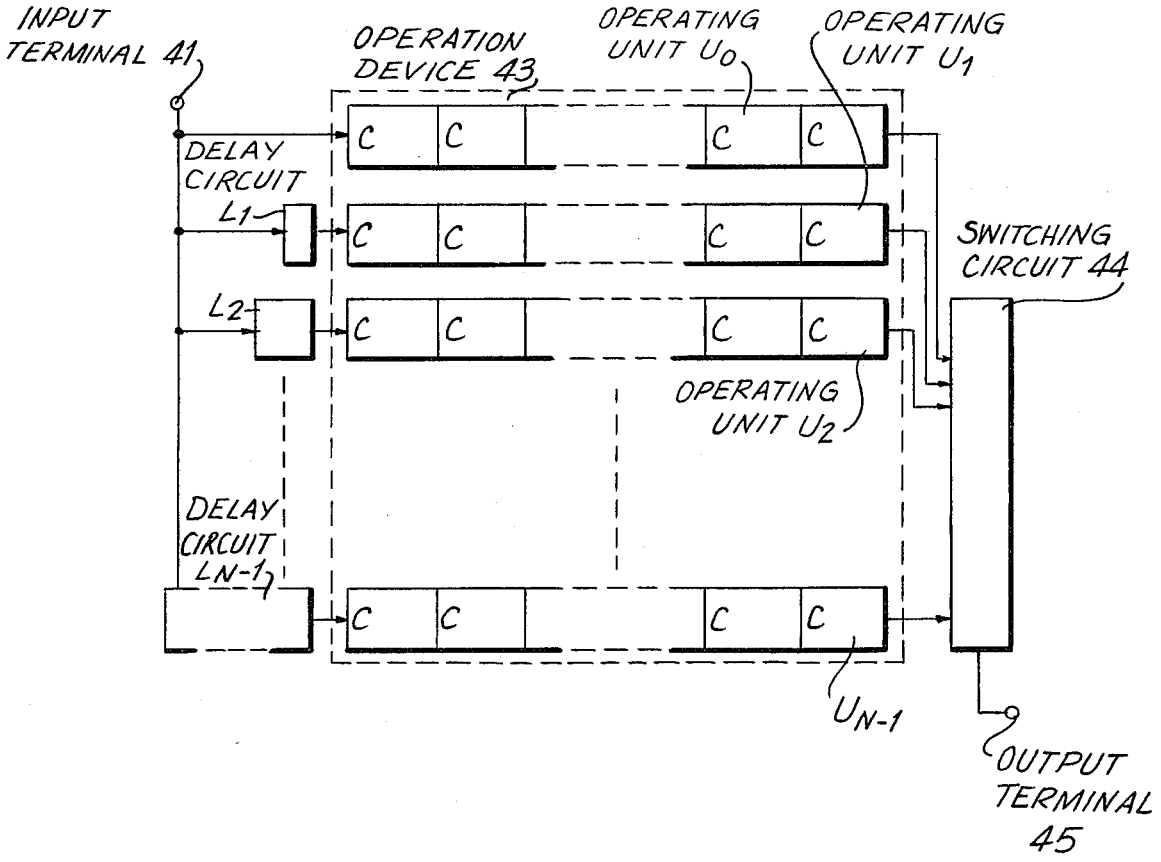
FIG. 4 is a block diagram of a third embodiment of the semiconductor matrix operation device of the invention.

In the embodiment of the matrix operation device shown in FIG. 4, an input signal applied to an input terminal 41 is input without delay to an operating unit $U_0$ of an operation device 43. The input signal is also input to the other operating units $U_1, U_2, \ldots, U_{N-1}$ via delay circuits $L_1, L_2, L_3, \ldots, L_{N-1}$, respectively. In the embodiment of FIG. 4, when it is assumed that the delay time of the analog delay circuits is $\tau_1, \tau_2, \tau_3, \ldots, \tau_{N-1}$, respectively, these delay times $\tau_1 \sim \tau_{N-1}$ form an arithmetic series in which $\tau_1<\tau T_2<T_3 \ldots <T_{N-1}$. With such an input circuit, the input sequence $g_0, g_1, g_2, \ldots g_{N-1}$ may be input to the operation device 43 in an adequate timing relation. A switching circuit 44 is provided in the output. The output signal is provided at an output terminal 45.

It is thus shown that each of the plurality of analog delay circuits has a final stage, a delay time and a transfer direction which is the same as that of each unit of the operation device. The input circuit thus provides sampled data of an input signal to be transformed as a simultaneous input to all the delay circuits. The final stage of each of the delay circuits has a charge which the sampled data of the input signal at respectively different instants.

Figure 5:
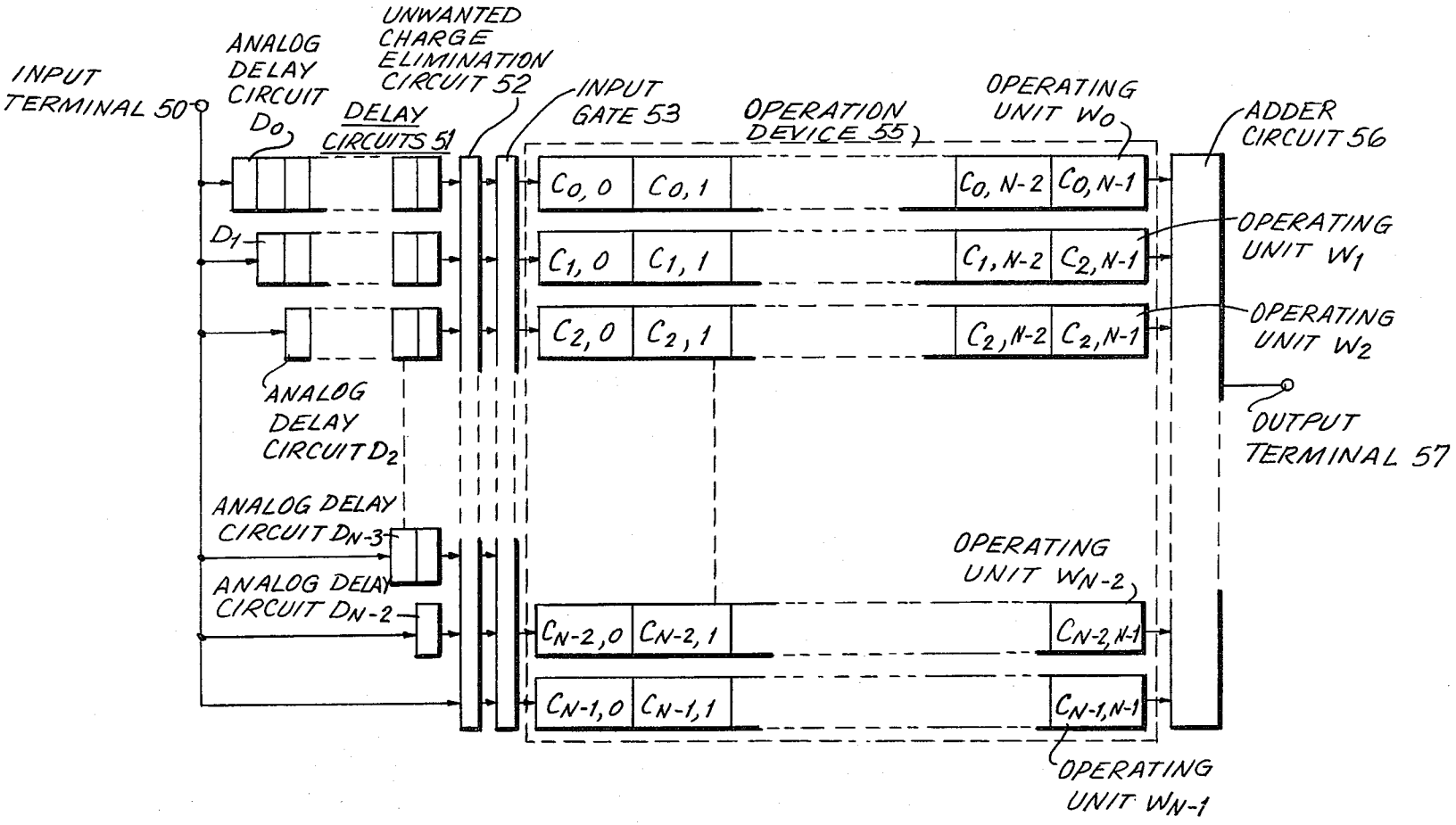
FIG. 5 is a block diagram of a fourth embodiment of the semiconductor matrix operation device of the invention.

In the embodiment of FIG. 5, the inter-relation between the weighting coefficient of each operating unit of the operation device and each element of the matrix of Equation (1) is different from that of FIGS. 1 and 3.

In the operation device 55 of the embodiment of FIG. 5, each coefficient $C_{0,0}, C_{0,1}, \ldots, C_{0,N-2}, C_{1,N-1}$ in the first unit $W_0$, for example, corresponds to the arrangement of the first vertical direction, or first column, of the matrix of Equation (1). Equation (1) is indicated again, as follows.

$$\begin{pmatrix} F_0 \\ F_1 \\ F_2 \\ \vdots \\ F_{N-1} \end{pmatrix} = \begin{pmatrix} C_{0,0} & C_{1,0} & \cdots & C_{N-1,0} \\ C_{0,1} & C_{1,1} & \cdots & C_{N-1,1} \\ C_{0,2} & C_{1,2} & \cdots & C_{N-1,2} \\ \vdots & \vdots & & \\ C_{0,N-1} & C_{1,N-1} & & C_{N-1,N-1} \end{pmatrix} \begin{pmatrix} g_0 \\ g_1 \\ g_2 \\ \vdots \\ g_{N-1} \end{pmatrix} \quad (1)$$

The coefficient of the operating unit $W_0$ corresponds to the coefficients $C_{0,0}$ to $C_{0,N-1}$ of the first column of Equation (1). The input circuit of the embodiment of FIG. 5 is provided with analog delay circuits $D_0$ to $D_{N-2}$. The delay circuit $D_0$ provides the maximum time delay and the delay circuit $D_{N-2}$ provides the minimum time delay. In the embodiment of FIG. 5, as in the embodiment of FIG. 4, the delay times of the delay circuits form an arithmetic series. The signal to be transformed is applied to an input terminal 50 and passes through the delay circuits 51. The signal is then supplied to the operation device 55 after passing through an unwanted charge eliminator 52 and an input gate 53.

The unwanted charge eliminator 52 functions to prevent disruption of the operation of the delay circuits due to accumulation of unwanted charge at the analog delay circuits. In other words, when a charge transfer device, or CTD, is used as each analog delay circuit, a signal is simultaneously applied to all the CTDs. However, since the delay time, and therefore the number of transfer stages, of the different delay circuits are different, the signal charges in other delay circuits must be sequentially transferred to the output and then eliminated, until the signal reaches the final stage of the delay circuit $D_0$, which has the longest delay time. The unwanted charge elimination circuit 52 is provided for this purpose in the embodiment of FIG. 5.

The input gate 53 does not open until the samples of the input signal $g_0, g_1, g_2, \ldots, g_{N-1}$ enter the charge elimination circuit 52 simultaneously. All the samples are thereby input simultaneously to the operation circuit or device 55. The signal in the operation circuit 55 is subject to multiplication by the coefficient, added in an adder circuit 56, and then provided at an output terminal 57.

Figure 6:
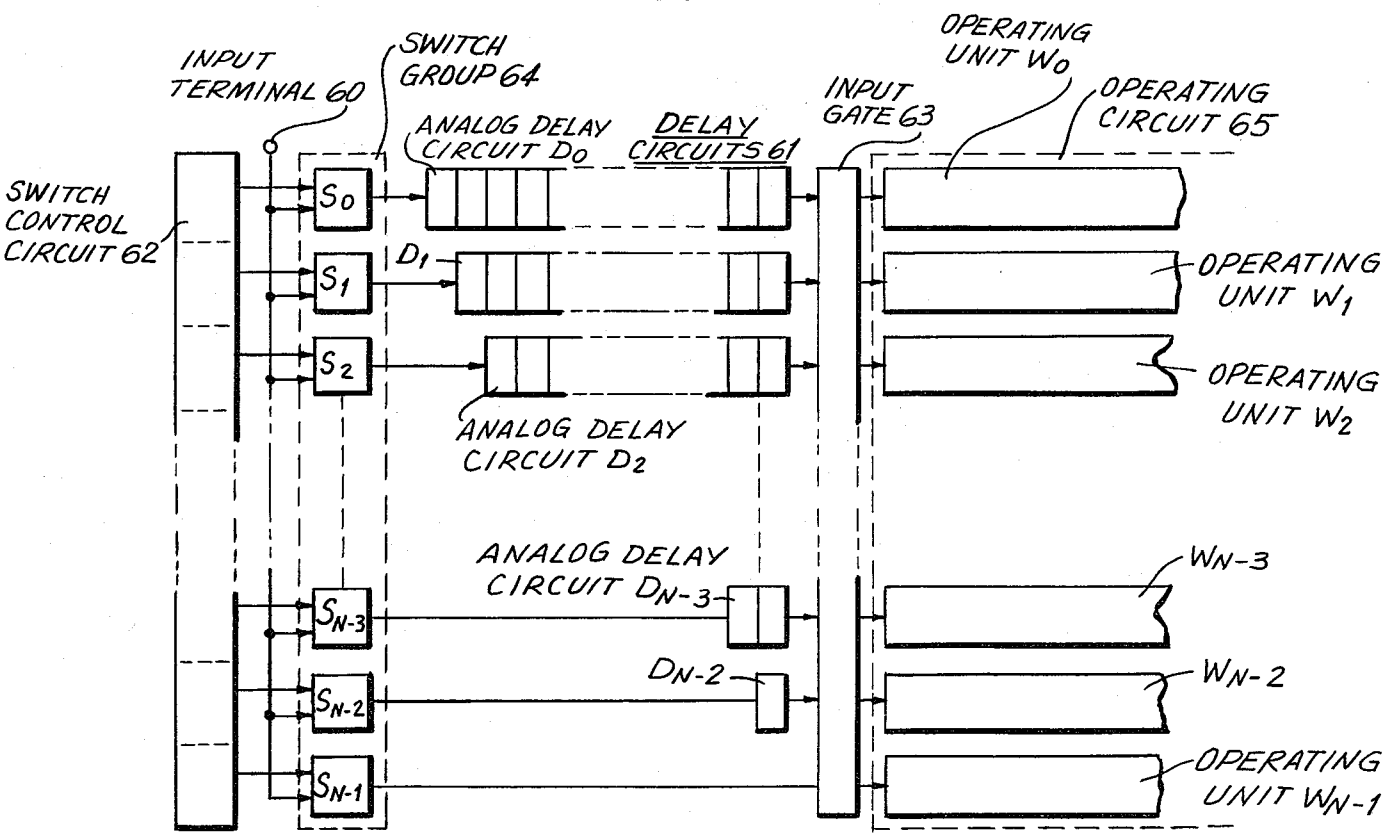
FIG. 6 is a block diagram of a fifth embodiment of the semiconductor matrix operation device of the invention.

In the embodiment of FIG. 6, the unwanted charge elimination circuit is eliminated by providing a switch group in the input of the analog delay circuit. The switch group 64 consists of N electronic switches $S_0$ to $S_{N-1}$. Each switch opens for the specified period in the sequence of $S_0 \rightarrow S_1 \rightarrow S_2 \ldots \rightarrow S_{N-1}$.

The difference in the OPEN time between the switches $S_0$ to $S_{N-1}$ is equal to the difference in the delay time between the analog delay circuits $D_0$ to $D_{N-2}$, respectively, connected to each other. A switch control circuit 62 controls the ON and OFF timing of each switch $S_0$ to $S_{N-1}$ of the switch group 64. In the circuit of FIG. 6, a signal is not applied to each CTD of the analog delay circuits 61 while each switch is closing. Thus, the unwanted charge eliminating circuit 52 of the embodiment of FIG. 5 is eliminated. Each of the electronic switches $S_0$ to $S_{N-1}$ of the switch group 64 preferably comprises a field effect transistor, although a bipolar transistor may be used.

Figure 7:
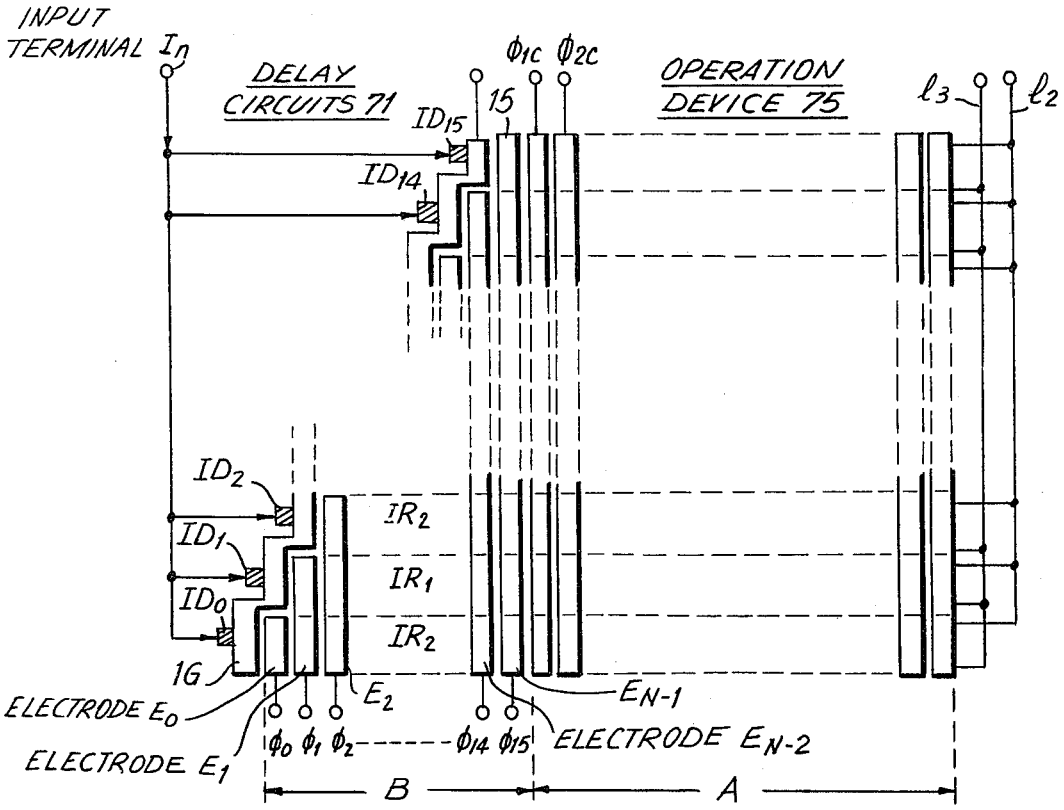
FIG. 7 is a block diagram of a sixth embodiment of the semiconductor matrix operation device of the invention.

The embodiment of FIG. 7 is different from the embodiment of FIG. 5 in the configuration of the delay circuits in the input. In the embodiment of FIG. 7, delay circuits 71 consist of a type of CTD having an electrode shaped considerably differently from that of the ordinary CTD. First of all, the electrodes $E_0, E_1, E_2, \ldots, E_{N-1}$ are different in length, and become longer, in the sequence of the suffixes, as they progress from the first electrode. Each of the electrodes $E_0$ to $E_{N-1}$ is electrically independent from the others and each may have different potentials, individually.

When a pulse is applied to each electrode $E_0, E_1, E_2, \ldots, E_{N-1}$ in this sequence of FIG. 7, the signal charge is input to each electrode in the sequence of the suffixes 0, 1, 2, . . . . The signal charge is then transferred to the operation device 75, passing through the area under each electrode sequentially. Thus, the delay times of the samples $g_0, g_1, g_2, \ldots, g_{N-1}$ form an arithmetic series, so that all the samples $g_0$ to $g_{N-1}$ are input simultaneously to the operation device or circuit 75. The embodiment of FIG. 7 thereby performs the same operations as the embodiments of FIGS. 5 and 6.

In the matrix operation or signal transforming device of the type shown in FIGS. 5, 6 and 7, when a signal charge enters a specific unit, the next signal charge does not enter the unit until the preceding signal charge has passed through said unit. This is different from an ordinary filter. It is therefore possible to split several electrodes within one transfer stage.

Figure 8:
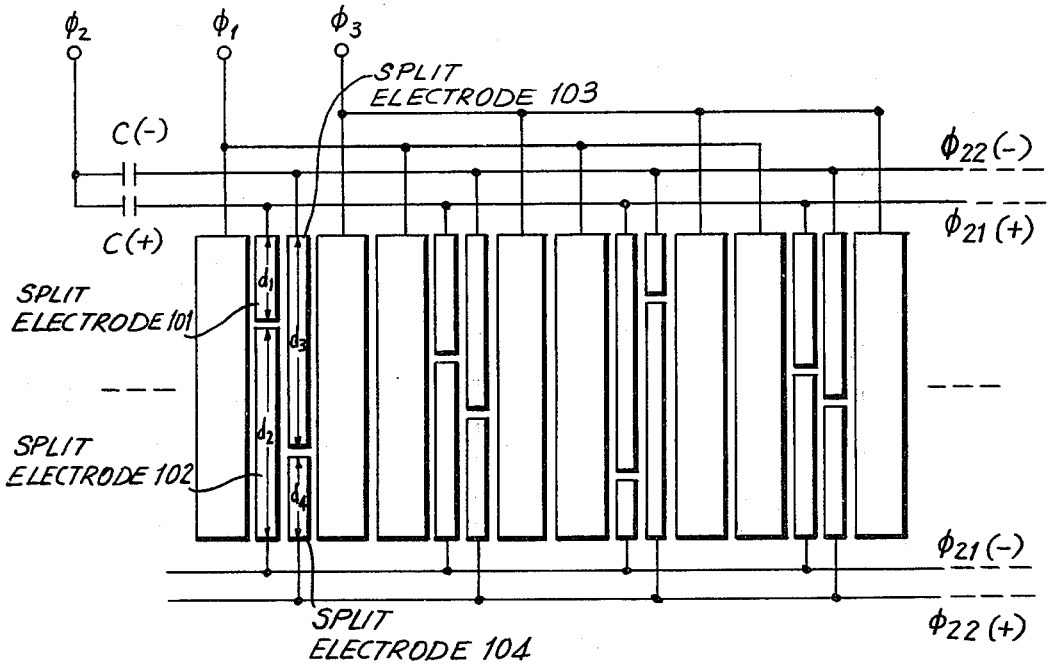
FIG. 8 is a block diagram of a seventh embodiment of the semiconductor matrix operation device of the invention.

FIG. 8 shows the principal portion of an embodiment wherein adjacent pairs of electrodes of a three-phase driving type CTD are split. In the embodiment of FIG. 8, the weighting coefficients provided by split electrodes 101 and 102, and 103 and 104, respectively, become equal to each other. When the lengths of the split electrodes 101, 102, 103 and 104 are considered to be $d_1$, $d_2$, $d_3$ and $d_4$, respectively, $d_1:d_2=d_4:d_3$. Although buses $B_3$ and $B_{3'}$, $B_4$ and $B_{4'}$ are not shown in the FIGS., they are always at the same potential, and one end is connected.

In an example of the embodiment of FIG. 8, an error in the weighting coefficient due to a vertical deviation of the mask for photo-etching in order to split the electrodes may be eliminated.

Figure 9:
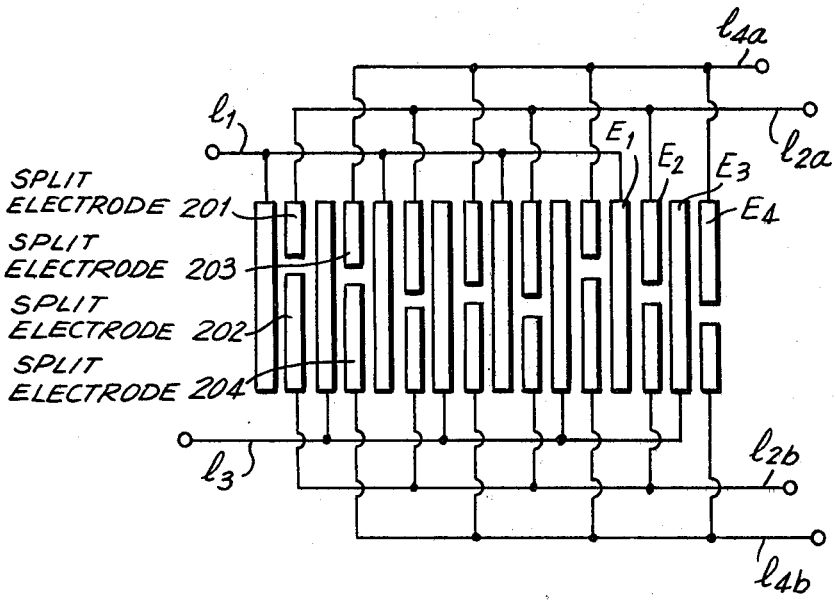
FIG. 9 is a schematic diagram of adjacent pairs of electrodes of charge transfer devices split at different ratios.

In the embodiment of FIG. 9, the weighting coefficient $h_1$ provided by the split electrodes 201 and 202 and the weighting coefficient $h_2$ provided by the split electrodes 203 and 204 are generally set differently, so that $h_1 \neq h_2$. The embodiment of FIG. 9 successfully reduces the number of electrodes, compared to the electrodes of a device in which only one electrode among three in one transfer stage is split in a known three-phase driving type CTD.

While the invention has been described by means of specific examples and in specific embodiments, we do not wish to be limited thereto, for obvious modifications will occur to those skilled in the art without departing from the spirit and scope of the invention.

We claim:

1. A semiconductor signal transforming device for matrix operating a signal of analog type having a continuous amplitude, said semiconductor signal transforming device including an operation device having an input and a plurality of multi-stage charge coupled devices arranged in parallel with the same transfer direction, each of said charge coupled devices having split electrodes for providing a weighting coefficient to respective stages so as to act as an operating unit, an input circuit connected to the input of the operation device, said input circuit having a plurality of analog delay circuits each having a final stage and connected to a corresponding charge coupled device of said operation device, said input circuit providing sampled data of an input signal to be transformed as a simultaneous input to all said delay circuits, the final stage of each of said delay circuits having a charge which is the sampled data of said input signal at respectively different instants, an output circuit connected to an output of said operation device for receiving an output signal operated in the respective charge coupled device for operation, wherein each of said analog delay circuits having another type of charge coupled device with a different number of transfer stages, and each of said charge coupled devices for delaying are respectively coupled at said final stages of said delay circuits to said charge coupled devices for operation with relation to the two transfer directions of the two types of charge coupled devices and become of the same direction.

2. A semiconductor signal transforming device as claimed in claim 1, further comprising means for supplying a signal to be transformed only to one charge transfer device of the operation device.

3. A semiconductor signal transforming device as claimed in claim 1, wherein said delay circuits have different delay times, and further comprising means for supplying a signal to be transformed to said delay circuits and for supplying said signal to the charge transfer devices of the operation device after it passes through said delay circuits.

4. A semiconductor signal transforming device as claimed in claim 1, wherein each of said delay circuits comprises a charge transfer device having a transfer electrode, the length of the transfer electrode of each of the charge transfer devices increasing the closer the charge transfer device is to the operation device.

5. A semiconductor signal transforming device as claimed in claim 1, wherein the number of analog delay circuits of the input circuit is fewer by one than the number of charge transfer devices having split electrodes.

* * * * *

UNITED STATES PATENT AND TRADEMARK OFFICE

CERTIFICATE OF CORRECTION

PATENT NO. : 4,430,723

DATED : February 7, 1984

INVENTOR(S) : Kunihiro Tanikawa, Yuichiro Ito and Mitsuo Ishii

It is certified that error appears in the above-identified patent and that said Letters Patent are hereby corrected as shown below:

Title page, after line [76] insert the following line:

[73] Assignee: FUJITSU LIMITED, Kawasaki, Japan after the last line of [56] insert the following line:

Attorney, Agent or Firm - Daniel Jay Tick

Signed and Sealed this

Second Day of April 1985

[SEAL]

*Attest:*

DONALD J. QUIGG

*Attesting Officer*

*Acting Commissioner of Patents and Trademarks*